United States Patent [19]

Zanasi

[11] 4,062,386

[45] Dec. 13, 1977

[54] METHOD AND APPARATUS FOR THE DOSING OF DENSE PASTY SUBSTANCES

[75] Inventor: Luciano Zanasi, Bologna, Italy

[73] Assignee: Zanasi Nigris S.p.A., Ozzano Emilia, Italy

[21] Appl. No.: 672,538

[22] Filed: Apr. 1, 1976

[30] Foreign Application Priority Data

Apr. 7, 1975 Italy ..... 12556/75

[51] Int. Cl.[2] ..... B67C 3/00; B67C 3/26

[52] U.S. Cl. ..... 141/258; 53/281; 222/194; 264/138; 264/176 R

[58] Field of Search ..... 264/176 R, 153, 160, 264/334, 335; 425/810, 42, 290, 317; 141/1, 67, 71, 258; 222/194; 53/122, 281

[56] References Cited

U.S. PATENT DOCUMENTS

| | | | |
|---|---|---|---|
| 2,599,959 | 6/1952 | Webster | 141/1 |
| 2,775,267 | 12/1956 | Stirn et al. | 141/1 |
| 2,779,097 | 1/1957 | Frazier | 425/290 |
| 3,656,517 | 4/1972 | Taylor et al. | 141/1 |
| 3,893,492 | 7/1975 | Nohren | 141/1 |

*Primary Examiner*—Willard E. Hoag
*Attorney, Agent, or Firm*—B. P. Fishburne, Jr.

[57] ABSTRACT

The apparatus for dosing metered amounts of dense pasty pharmaceutical substances and for inserting same into gelatine capsules, comprises an extrusion press which extrudes a layer of substance having a uniform density and a predetermined thickness or height. A hollow punch presenting a cavity is dipped inside said layer for its whole thickness or height, so as to take out of said layer, due to the inherent viscosity of the substance, a predetermined dose of the substance itself. The hollow punch is the positioned above an empty capsule half, and the dose is discharged into the said capsule half by means of an ejecting piston slidably movable at the interior of the hollow punch. The extrusion press comprises two parallel walls, one of which is adjustable so as to vary its distance from the other wall, thus varying the thickness of the layer of substance being extruded.

3 Claims, 7 Drawing Figures

METHOD AND APPARATUS FOR THE DOSING OF DENSE PASTY SUBSTANCES

SUMMARY OF THE INVENTION

The present invention has for its object a process and apparatus for the dosing of metered amounts of dense pasty or anyhow semisolid substances, particularly for the dosing of dense pasty pharmaceutical substances and for the filling of gelatine capsules, used in the pharmaceutical industry, with the prepared dose.

The process and apparatus according to the invention more particularly contemplates the steps and means for producing a continuous uniform layer having a predetermined height, of the dense and pasty substance which is to be dosed, and of dipping inside said layer a hollow punch for a predetermined depth, which usually corresponds to the height of the layer, so that inside the cavity of the hollow punch there is obtained a dose of substance which subsequently can be carried in correspondence of, and deposited inside a open gelatine capsule. It appears evident that, by maintaining always the same thickness or height of the uniform layer of substance, and/or by dipping the hollow punch of the same predetermined depth, perfectly equal doses will be obtained. Preferably the layer of substance is formed by extrusion of the substance itself. Also, according to a preferred embodiment, the ejection of the dose of substance from the hollow punch inside the open gelatine capsule takes place by means of a small piston-like ejector which is slidably movable at the interior of the hollow punch. Further, means may be provided for pushing the dose deeper inside the open gelatine capsule, in order to permit the insertion of other dosed amounts of other substances, to facilitate the closure of the gelatine capsule, of for any other reason.

These and other features of the invention and the advantages deriving therefrom will be clearly understood from the following description of a preferred embodiment thereof, with reference to the accompanying drawings.

DESCRIPTION OF THE PREFERRED EMBODIMENT

Figures 1, 2, 3, 4:
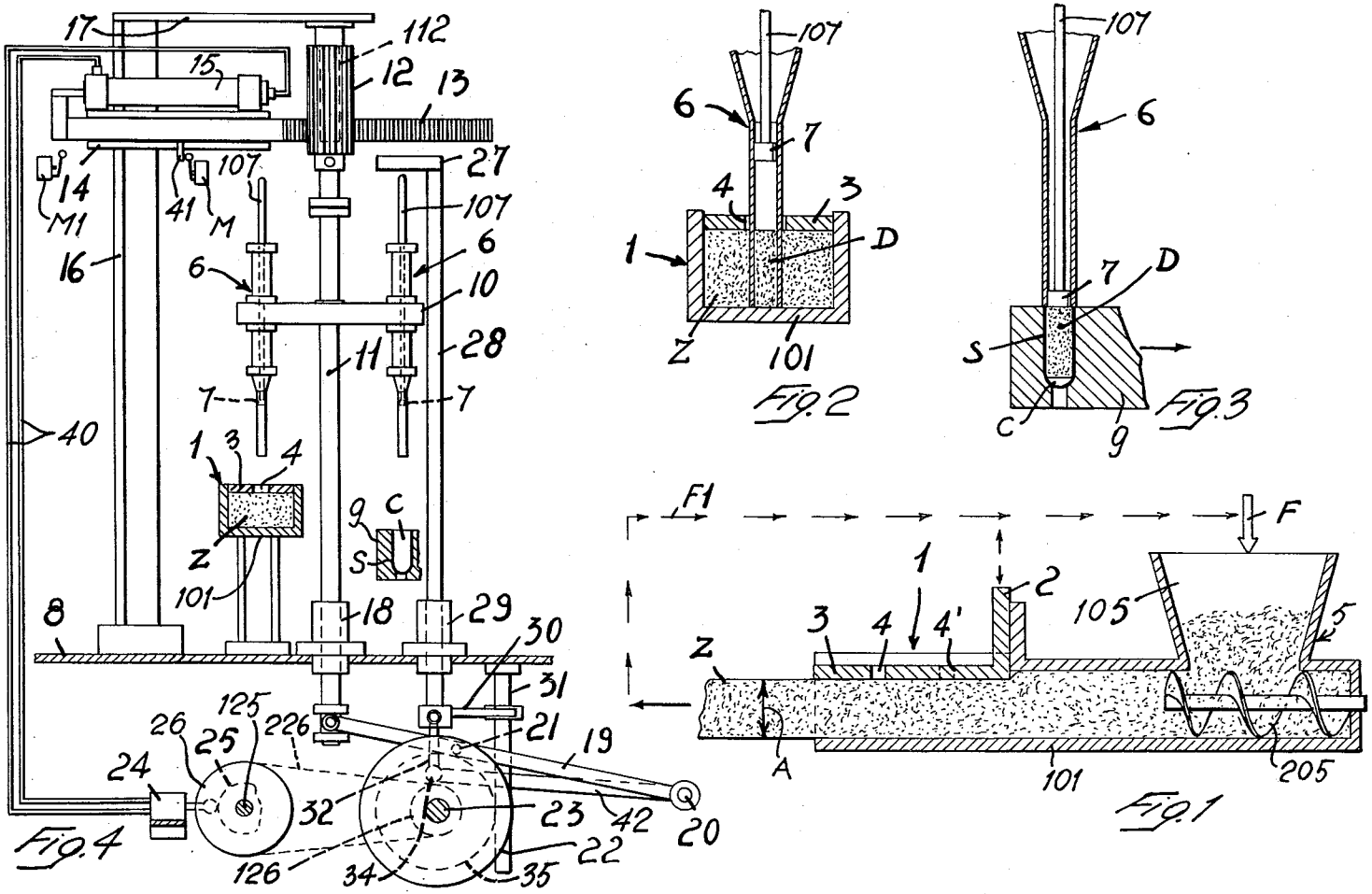
FIG. 1 is a vertical section showing the detail of the device for forming the extruded continuous layer of dense pasty substance.
FIG. 2 is a vertical section showing the hollow punch being dipped inside the extruded layer of dense pasty substance.
FIG. 3 is a vertical section showing the hollow punch ejecting the dosed amount of substance inside an open gelatine capsule.
FIG. 4 is a diagrammatic elevation view with parts in section showing the apparatus according to the invention, and, FIGS. 5 to 7 show as many operative steps of the device for further pushing the dose of substance deeper inside the gelatine capsule.

With reference to FIGS 1 and 2 of the drawings, the apparatus according to the invention comprises an extrusion device consisting of a horizontal extrusion channel 1, which presents a rectangular section and, at least for a predetermined length, a lower horizontal flat bottom wall 101 and an upper horizontal flat top wall 3. The top wall 3 can be adjusted in its height with respect to the bottom wall 101 and can be blocked in any desired position with the help of its vertical side wall element 2. The upper wall 3 presents at least one through bore 4, for permitting the passage of a tubular hollow punch 6 presenting at its interior a cavity and slidably mounted inside said cavity an axially movable ejecting piston 7.

The channel 1 is connected to an extrusion device 5 which comprises a hopper 105 inside which the dense pasty substances is fed, and a screw 205 which extrudes the substance beyond the vertical side wall 2 into the said channel 1 thus forming a continuous layer Z of compact and homogenous dense pasty substance. The layer of substance flowing out of the outlet end of channel 1, after that the doses have been taken out of it, is again brought inside hopper 105, as diagrammatically shown by arrows F1 in FIG. 1. To this purpose, any suitable means can be used, which have not been illustrated, and are well known to any person skilled in the art.

It is to be noted that the layer Z has a constant predetermined height A, which depends from the relative adjustment of the top wall 3 of the rectangular extrusion channel 1, with respect to the bottom wall 3 of the said channel.

In order to take a predetermined metered amount or dose D of the substance, the tubular hollow punch 6 is lowered by passing through the bore 4 and is thus dipped into the pasty substance layer Z, the flow of which in the meantime has been temporarily stopped. The ejecting piston 7 is in its lifted position, as it appears clearly from FIG. 2. In this manner, the hollow punch 6 is filled in correspondence of its lower portion with a dose D of substance which corresponds to the height A of the layer Z.

Finally, the hollow punch 6 is lifted from the extrusion channel 1 together with the dose D, which remains attached at the inside of the said punch due to its inherent adhesiveness and viscosity. In order to ensure a perfect detachment of the lower portion of the dose D from the flat surface of the bottom wall 101 of the extrusion channel 1, at the moment of the lifting of the hollow punch 6 there is provided, in a known manner, for a relative rotary or linear movement between the said punch and the said surface of the bottom wall 101.

As above mentioned, during the dipping operation of the hollow punch 6 inside the layer Z of substance, the flow of said substance layer is stopped. Said flow is resumed again as soon as the punch 6 has been lifted out of the substance, and it proceeds, until the next dipping movement of the hollow punch 6, of a distance which is greater than the diameter of the hollow punch itself, in order to ensure that the next dipping of the punch may take place into a portion of the layer which was not interested by the preceding dipping in.

The thus dosed quantity D of substance is carried, by the same hollow punch 6, in correspondence of the container into which it is to be discharged. In the present case the dosed substance is a pharmaceutical product, and same is discharged inside the open-top base portion C of a two-piece gelatine capsule (also referred to as capsule half) arranged inside the capsule holder of a suitable conveyor 9, which is preferably of the well known turn-table type. The hollow punch 6, carrying the dose D, is axially aligned in correspondence of the open top of the said base portion C, and the piston 7 is then lowered so as to promote the discharge of the dose D inside the said base portion C of the gelatine capsule.

In order to favour the detachment of the dose D from the hollow punch 6 and its descent inside the capsule portion C, there may be provided for a small jet of air or any other suitable gas, which can flow through the clearance existing between the piston side and the inner cylindrical surface of the cavity of hollow punch 6. At this point, either the conveyor 9 or the punch 6, or both, are moved along an horizontal plan, and the consequent relative displacement of the two parts which were axially aligned (the hollow punch 6 and the capsule bottom C) ensures a "scraping" action which further favours the detachment of the pasty substance from the hollow punch.

Figure 7:
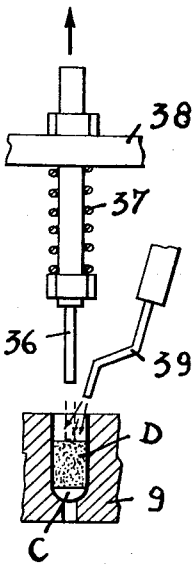
Figure 6:
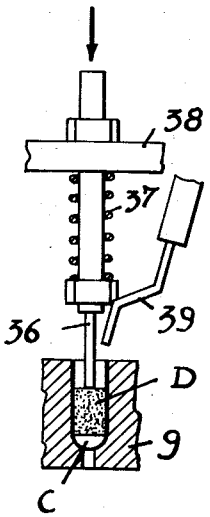
Figure 5:
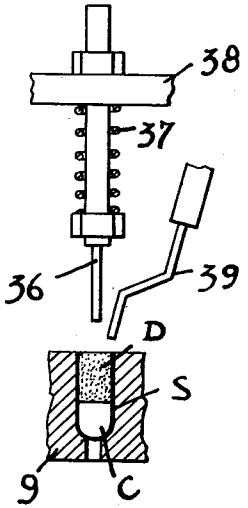

In the case that the dose D presents a height (substantially corresponding to the height A of the layer Z) which is smaller than the height of the capsule half C, it might be advisable, for the closure of the capsule with the other capsule half, or for any other operation (such as may be the subsequent insertion of other substances into the capsule), to press the dose D deeper towards the proper bottom of the capsule half. To this purpose (see FIGS. 5 to 7) there is provided, in correspondence of one station of the turn-table conveyor 9, a plunger 36 mounted vertically movable on a supporting plate 38, with the interposition of a spring 37 which urges same downwardly. The supporting plate 38 is vertically movable to-and-fro with respect to the underlying conveyor 9. In correspondence of each plunger 36 there is arranged a fixed nozzle 39 which provides a downwardly directed jet of air or other suitable gas. The downward movement of the supporting plate 38 promotes the corresponding movement of plunger 36, which elastically pushes the dose D further deeper inside the capsule half C. When the plate 38 and associated plunger 36 are lifted, a small jet of air is blown by nozzle 39 thus ensuring the detachment of the plunger tip from the upper surface of the dose D which had been in contact with the said plunger tip.

In FIG. 4 there is diagrammatically shown an apparatus incorporating the above described devices and which is suitable for carrying out the described process, for the filling of gelatine capsules with doses of dense pasty pharmaceutical substances. The apparatus presents a basement 8 provided with a bushing 18 for the shaft 11, which is mounted rotatable and also axially shiftable. At a certain height, the shaft 11 carries a support bar 10 which presents, in diametrally opposed locations, two hollow punches 6. Located below said support bar 10 there is arranged, secured to the basement 8, the horizontal channel 1 through which flows the extruded layer Z.

On the side of shaft 11 which is diametrally opposed to channel 1 there is arranged the turn-table conveyor 9, which carries the halves of the gelatine capsules C to be filled with the dose D. The shaft 11, and the support bar 10 mounted thereon, is rotated of 180° either in the same direction or, as shown in the illustrated embodiment, in clockwise and anticlockwise alternating directions. To this purpose, onto an upright column 16 of the machine basement 8, there is slidably mounted, on guides 14, a horizontal rack 13, which engages with its toothed portion a pinion 12 keyed on shaft 11 and presenting a height which is at least equal to the height of the axial displacement of said shaft 11. Pinion 12 presents an upper open cavity, such as a bushing, which is engaged by a bearing pin 112 arranged at the end of an overhanging arm 17, thus providing for the end bearing of shaft 11, although permitting its rotation and axial displacement. The alternating rotary movement of shaft 11 is promoted by the axial movement of the piston rod of a double-acting pneumatic or hydraulic cylinder 15, said rod being connected to and arranged parallely with respect to the rack 13. The operation of cylinder 15 is promoted through the conduits 40 to which the fluid under pressure is distributed by the distributor 24, actuated by cam 25 keyed on pulley 125 which receives its drive from pulley 126 through the belt 226 from the main drive shaft 23.

The vertical up-and-down motion of shaft 11 is obtained through lever 19 hinged at one end to the corresponding lower end of shaft 11, and at the other end to a fixed articulation point 20. An intermediate cam follower engages a surface cam 22 keyed on driving shaft 23. The downward movement of pistons 7 provided at the interior of the hollow punches 6 is obtained through the overhanging end 27 of an actuating rod 28 which passes through a bushing 29 provided on the machine frame 8. The lower end of the actuating rod 28 is provided with a side arm 30, which is slidably guided along a downwardly projecting shaft 31, secured to the machine frame, thus avoiding any accidental rotation of the said actuating rod. The said lower end of the actuating rod 28 is linked to a lever 42 hinged at the other end to the fixed articulation point 20, and provided at an intermediate point with a cam follower 21 which engages the cam surface 22 keyed on shaft 23. The pistons 7 are normally urged upwards by spring means (not shown), in a known manner.

The operation of the just described apparatus takes place in the following manner:

Considering the hollow punch at the left-hand-side in FIG. 4, same as caused to be lowered by the downward movement of shaft 11, while the piston rod of cylinder 15 is blocked in the position illustrated. The hollow punch dips into the extruded layer of substance Z inside channel 1, and then it is raised, through the movement of shaft 11, taking out a dose D. At this moment, the distributor 24 promotes the displacement of the piston rod of cylinder 15, thus causing the rotation of 180° of shaft 11, and arranging the punch 6 loaded with the dose D so as to be located above and in alignment with the empty capsule C carried by the turn-table conveyor 9. The lowering of shaft 11 takes place again, while actuating rod 28 promotes the lowering of the ejecting piston 7, which expels the dose D from the punch 6 into the capsule C. Subsequently, as above mentioned, on a further station of conveyor 9, there may be provided the device shown in FIGS. 5 to 7, for pushing the dose D still deeper inside the capsule half C.

Of course, the operation of the two hollow punches 6 arranged on the support 10 takes place simultaneously, that is to say when one punch 6 dips down to take a dose of substance, the other punch discharges its dose inside the capsule half C.

Suitable limit switches M and M1 are provided on the machine frame in a fixed position with respect to an abutment member 41 carried by rack 13. The mentioned limit switches are arranged so at to give their consent to the lowering of shaft 11 only whenever the hollow punches 6 carried by it are exactly positioned in alignment with the through bore 4 provided in channel 1, respectively with the capsule half C carried by conveyor 9.

It is believed that the invention will have been clearly understood from the foregoing detailed description of a preferred embodiment. Changes in the details of construction may be resorted to without departing from the spirit of the invention, and it is accordingly intended that no limitation be implied and that the hereto annexed claims be given the broadest interpretation to which the employed language fairly admits.

I claim:

1. An apparatus for the dosing of dense pasty semisolids, particularly for the filling of gelatin capsules with such substances comprising means for forming a layer of substance having a uniform density and thickness, at least a hollow punch having a cavity, means for lowering the hollow punch so as to dip into said layer and for lifting it from said layer whereby the hollow punch removes in its cavity a predetermined dose of substance, means for transporting said hollow punch carrying said dose into registration with a gelatin capsule to be filled, and ejector means operable to discharge said dose from the hollow punch into the gelatin capsule, and said means for forming said layer having a uniform density and thickness comprising an extrusion press which extrudes a continuous flow of said substance through a channel having two parallel walls, and one of said walls having at least one through bore through which the hollow punch can be inserted into the extruded substance.

2. An apparatus according to claim 1, in which one of the said parallel walls of the channel can be displaced so as to vary its distance from the other wall.

3. An apparatus according to claim 1, further comprising reciprocating plunger means for pushing the dose discharged into the capsule deeper at the interior of the capsule itself, said plunger means comprising a plunger rod which is movable so as to penetrate partially at the interior of the capsule, means for providing a jet of gas being also provided in order to cooperate with said plunger at least during the movement of the plunger away from the dose and out of the capsule.

* * * * *